US006308850B1

(12) United States Patent
Coom et al.

(10) Patent No.: US 6,308,850 B1
(45) Date of Patent: Oct. 30, 2001

(54) LINER FOR CONTAINER

(75) Inventors: Noel Coom, Milford (NZ); Glenn Arthur Peters, Blacktown (AU)

(73) Assignee: VISY R & D pty Ltd. (AU)

( * ) Notice: Subject to any disclaimer, the term of this patent is extended or adjusted under 35 U.S.C. 154(b) by 0 days.

(21) Appl. No.: 09/335,637

(22) Filed: Jun. 18, 1999

(30) Foreign Application Priority Data

Jun. 19, 1998 (AU) ..... PP4241

(51) Int. Cl.[7] ..... B65D 5/58
(52) U.S. Cl. ..... 220/62.1; 220/62.2; 229/122.32
(58) Field of Search ..... 220/636, 66.2; 229/122.32, DIG. 30

(56) References Cited

U.S. PATENT DOCUMENTS

| | | | | |
|---|---|---|---|---|
| 3,397,831 | * | 8/1968 | Adams | 229/122.32 |
| 3,744,702 | * | 7/1973 | Ellison | 229/122.32 |
| 4,260,071 | * | 4/1981 | Bamburg et al. | 229/122.32 |
| 4,380,314 | * | 4/1983 | Langston, Jr. et al. | 229/122.32 |
| 4,706,809 | * | 11/1987 | Halsell | 229/122.32 |
| 5,356,014 | * | 10/1994 | Berner | 229/122.32 |
| 5,417,342 | * | 5/1995 | Hutchison | 229/122.32 |
| 5,447,225 | | 9/1995 | Gunn et al. . | |
| 5,988,491 | * | 11/1999 | Morrison | 229/122.32 |
| 6,041,958 | * | 3/2000 | Tremelo | 220/636 |

FOREIGN PATENT DOCUMENTS

A-882893.82 7/1981 (AU) .

* cited by examiner

*Primary Examiner*—Joseph M. Moy
(74) *Attorney, Agent, or Firm*—Paul & Paul

(57) ABSTRACT

A liner for a container, such as a shipping container, including an end panel (11), a first side wall panel (12), a second side wall panel (13), a floor panel (14), a roofpanel (15) and a second end panel (16), the end panel (11) including flaps (17), (18), end panel (12) including top flap (19) and a lower flap (not shown) the side wall panel (13) including similar top and lower flaps to side wall panel (12), the floor panel (14) including a first flap (20) and a second flap (21), the roof panel (15) including flap (22) and another flap (not shown) on the edge opposed to the edge carrying flap (22), the second end panel (16) including flap (23) and another flap (not shown) on the opposed edge to that carrying flap (23), the panels (11 to 16) being formed from double faced corrugated paperboard. At least panel (11), and preferably panels (13 to 16), can have multiple fold or score lines (25*a* to *c* and 26*a* to *c*) to enable folding at selected lines to fit different containers. Diagonal slots (31) can be provided at each corner to accommodate protuberances in the corners of the container.

8 Claims, 2 Drawing Sheets

LINER FOR CONTAINER

FIELD OF THE INVENTION

The present invention relates to a liner for lining a container, such as a shipping container, railway container, trucking container, storage container or transport container. The present invention also relates to a method for lining a container.

BACKGROUND OF THE INVENTION

Produce and goods are frequently stored and transported in large containers. Such large containers typically have inside dimensions of 7'8" (2337 mm) wide, 7'2" (2145 mm) high and 19'4" (5905 mm) long. However, there is no standard dimensions for such containers and in practice there is variation in the dimensions between containers. Furthermore, some containers may be approximately 40' (12.2 m) long. In addition to variations in the internal dimensions of containers, there is also variability in design details of the inner structure of containers, particularly in the corner post region and in the design features along internal edges of the container. Containers are typically made of metal and may have wooden floor installed therein.

Such containers typically have one end that comprises a lockable door or doors. The containers are loaded with produce and goods by opening the door or doors and stacking the produce and goods inside the container. As the containers age, they may start to rust in places, paint may start to flake from inside surfaces, dirt may build up on the floor and in corners and rails in the container, and grease and other contaminants may be deposited inside the container.

If a container is to be used for transporting food or food products, strict requirements are placed on the quality of the container. In order to meet the requirements for food export quality containers, the container must be clean on the inside and have no rust, flaking paint or other contaminants that may fall from the container onto the cargo. In order to meet food export quality container guidelines, it is currently necessary to steam clean or chemically wash the inside of each container each time the container is turned around and loaded with a new cargo. Repainting may also be required. These steps increase the time required to turn around a container and also increase the costs involved in turning around the container.

Food quality containers are becoming more widely used for export and transport of food products such as dairy cargoes, nuts, fruit, canned food, rice, etc. Such cargoes are typically bagged or boxed at a food preparation plant and the containers are subsequently loaded with the bagged or boxed products.

SUMMARY OF THE INVENTION AND OBJECT

Attempts have been made to provide container liners without commercial success. For example AU-A-88293/82. The Sherman company discloses a body liner for truck bodies in which liner sheets are clamped at the top and bottom. This arrangement does not lend itself to shipping containers and requires special clamping means to hold the liner in place. It would be prohibitively expensive to convert existing containers to this configuration.

U.S. Pat. No. 5,447,225 Davis et al, discloses a tray-shroud for shipping and storing packaged goods in which the shroud is a pre-formed sleeve, filled with goods, which telescopes into the tray. This arrangement does not differ greatly from the individual putting of the goods in boxes. It is expensive and each shroud must be designed for a specific tray. As such it is not commercially attractive.

It is an object of the present invention to provide an apparatus and a method for lining a container.

According to a first aspect the present invention provides a liner for a container, the container including side walls, at least one end wall, a roof and a floor, the liner including:

at least one first side panel for positioning adjacent a first side wall at least one second side panel for positioning adjacent a second side wall at least one end panel for positioning adjacent the at least one end wall wherein each of said at least one first side panel, at least one second side panel and at least one end panel include a main body panel and further include at least one foldable or hingeable flap provided on at least one edge of said main body panel, each of said panels being made from a self-supporting paperboard material, such as corrugated paperboard whereby the liner does not require separate elements to hold it in place.

The liner may further include at least one roof panel for positioning above a load of cargo in said container.

The liner may further include at least one floor panel for positioning on the floor of the container.

The liner may also include at least one second end panel for positioning adjacent a second end of the container. The second end of the container may comprise one or more doors and the at least one second end panel is located adjacent said one or more doors when said one or more doors is closed.

Preferably, the at least one roof panel includes a main body portion and at least one foldable or hingeable flap provided on at least one edge of the main body panel.

The at least one second end panel may also include a main body panel and at least one foldable or hingeable flap provided on at least one edge of the main body panel.

Similarly, the at least one floor panel may include a main body panel and at least one foldable or hingeable flap provided on at least one edge of the main body panel.

Preferably one, some or each of the at least one first side panel, at least one second side panel, at least one said panel, at least one second end panel, at least one roof panel and at least one floor panel include foldable or hingeable flaps provided on two opposed edges of the main body panel.

Preferably, said panels are made from a double face corrugated paperboard.

Preferably, the flap or flaps provided on an edge or on two opposed edges of the main body panel are formed by forming a fold line to delineate the edge or the two opposed edges of main body panel. In this case, each flap is defined by the material between a respective fold line and the edge of the panel.

The main body panel of the side panels and end panels preferably have a height that is substantially the same as the internal height of the container. The at least one end panel preferably comprises one end panel and this panel has a width that is preferably the same as the internal width of the container. The one end panel most preferably has foldable or hingeable flaps provided on two opposed edges of the main body panel. The end panel is preferably fitted into the container by placing the main body portion of the end panel against the end of the container and folding the flaps substantially perpendicularly to the main body panel such that the flaps are adjacent to either side walls of the container or the roof and floor of the container. Preferably, the end panel is oriented such that flaps lie adjacent the side walls of the container, The side wall panels preferably include flaps on two opposed edges. The side wall panels are positioned inside the container such that the main body panel lies against the side wall and the flaps are folded substantially perpendicularly to the main body panel and the flaps lie adjacent to the roof and the floor of the container. The side wall panels positioned rearmost inside the container are most preferably positioned such that the rearmost vertical edge of the side wall panel is positioned close to the main body panel of the end panel (and suitably almost touching the end panel) with the flaps of the end panel located between the side wall panel and the side wall of the container. In this way, the positioning of the end panel and the side wall panels and their respective flaps ensure that the liner provides a substantially closed surface between the container walls and the cargo.

Once at least some of the side wall panels have been positioned inside the container, the at least one floor panel can be placed on the floor. The floor panel preferably has a width substantially the same as the internal width of the container. If the floor panel(s) comprise a main body panel and foldable or hingeable flaps, the flaps are folded substantially perpendicularly to the main body panel. The floor panel is suitably oriented such that the flaps extend upwardly against the side wall panels.

The liner preferably includes a plurality of floor panels. This enables the floor to be progressively covered by floor panels as the container is filled with cargo and this avoids workmen or vehicles filling the container with cargo from unduly walking on Or driving on the floor panels, which assists minimizing damage to the floor panels. As one floor panel is covered by cargo, another floor panel is positioned on the floor of the container.

When the container is loaded with cargo, the roof panel(s) are slid into place between the top of the cargo and the roof of the container. Preferably, the roof panels are located underneath the top flaps of the side wall panels. If the roof panel is provided with foldable or hingeable flaps those flaps are folded downwardly.

The positioning of the roof panel(s) and the flaps of the side wall panels provides an effective closed surface between the roof of the container and the cargo. Hence, any rust or flaking paint will fall onto the liner and not come into contact with the cargo.

Similarly, the floor panel(s) provide a physical barrier between the floor of the container and the cargo.

Once the container has been filled with cargo, the second end panel is positioned in a like manner to the first end panel and the door of the container is closed, ready for transporting.

The liner in accordance with the present invention acts as a physical barrier to rust, paint flakes and other contaminants coming into contact with the cargo. It also acts as a barrier to any condensation that may occur inside the container. The liner is simple to fit and requires very little training to use. The liner can be fitted in less then five minutes and has the potential to reduce cleaning and fit-out costs for food quality containers by up to two-thirds when compared with conventional cleaning and re-fitting. Furthermore, the liner greatly increases the number of containers that may be suitable candidates as food quality containers.

The foldable or hingeable flaps serve two purposes. Firstly, they assist in providing an effective closed surface between the container and the cargo once the liner is installed. Secondly, as there is no standard container dimensions, folding the flaps can effectively change the width or height of a panel such that it fits properly inside the container. In order to provide even greater adjustability in this regard, panels may be provided with two or more flaps along the edge, with each flap being defined by a respective fold line.

Containers may also be provided with various corner protuberances. In order to allow for easier fitting, the panels may be provided with diagonal cuts or cut lines extending from each corner into the panel. These cuts or cut lines enable small portions of the panel to be folded out of the way of corner protuberances.

The present invention also includes a method for lining a container.

In a second aspect, the present invention provides a method for lining a container with a liner including the steps of positioning an end panel against a rear wall of the container, positioning side wall panels against side walls of the container and placing at least one floor panel on a floor of a container.

The method preferably further includes the steps of folding one or more flaps on the end panel such that the one or more flaps lie against one or more side walls of the container. The step of positioning the one or more side wall panels may include folding one or more flaps of the side wall panels such that the one or more flaps lie against the roof and/or floor of the container. The step of placing the floor panel on the floor may include placing the floor panel over lower flaps of the side wail panels, which lower flaps are positioned adjacent to the floor of the container.

The method may further comprise loading the container with cargo and positioning at least one roof panel between the roof of the container and the top of the cargo.

The method may further include the step of positioning a rear end panel in the container when the container has been filled with cargo.

The invention also provides a panel for use in a liner for a container, the panel comprising a main body portion and having at least one foldable or hingeable flat on at least one edge thereof. Preferably, the panel includes foldable or hingeable flaps on two opposed edges thereof. Preferably, the panel is made from a self-supporting material, especially paperboard, more especially corrugated paperboard, most especially double faced corrugated paperboard. The flaps are preferably delineated by fold lines formed on the panel. Preferably, a plurality of fold lines extending substantially across the width of the panel are provided on each of the two opposed edges.

BRIEF DESCRIPTION OF THE DRAWINGS

A preferred embodiment of the present invention will now be described with reference to the accompanying drawings in which.

DESCRIPTION OF PREFERRED EMBODIMENT

Figure 1:
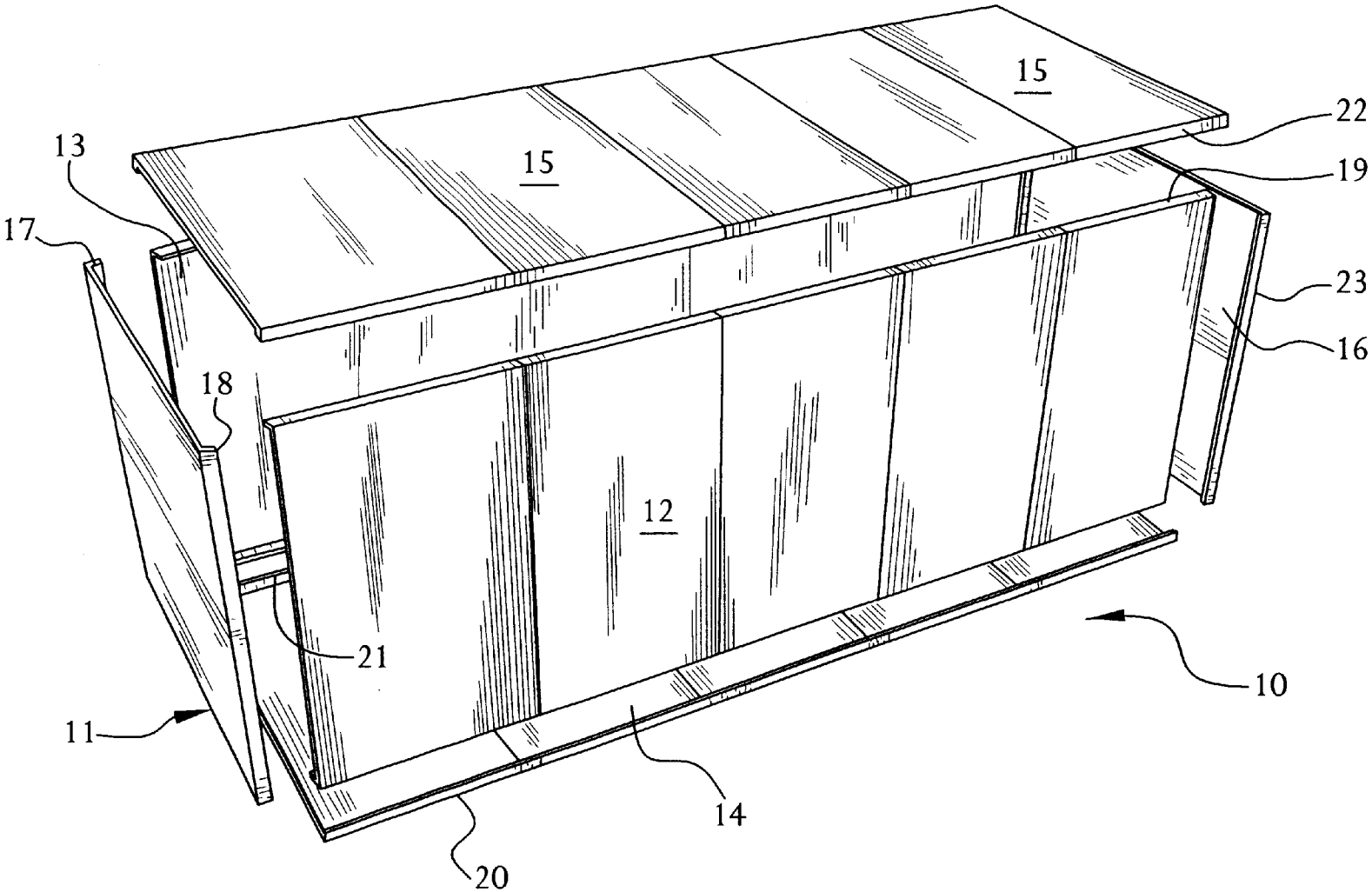
FIG. 1 shows a perspective view of a liner in accordance with the present invention. The liner shown in FIG. 1 is represented in an apart configuration for ease of viewing.

FIG. 1 shows a schematic diagram in accordance with the present invention. The liner 10 includes an end panel 11, a first side wall panel 12, a second side wall panel 13, a floor panel 14, a roof panel 15 and a second end panel 16.

End panel 11 includes flaps 17, 18. End panel 12 includes top flap 19 and a lower flap (not shown). Side wall panel 13 includes similar top and lower flaps to side wall panel 12. Floor panel 14 includes a first flap 20 and a second flap 21. Roof panel 15 includes flap 22 and another flap (not shown) on the edge opposed to the edge carrying flap 22. Second end panel 16 includes flap 23 and another flap (not shown) on the opposed edge to that carrying flap 23.

Figure 2:
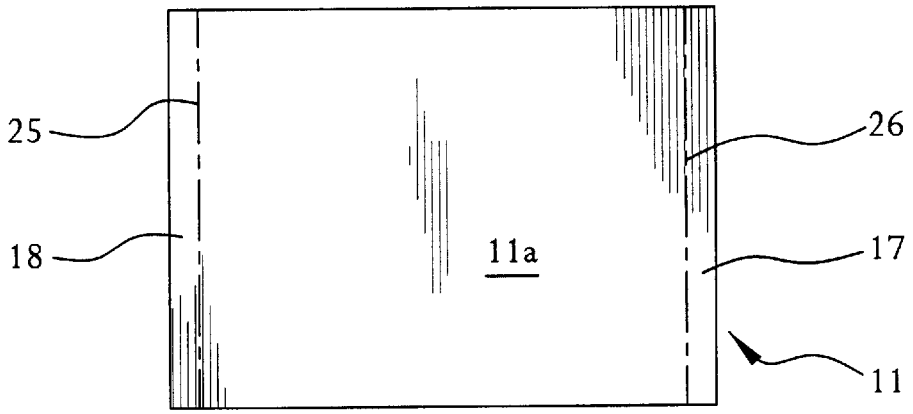
FIG. 2 shows an end view of a liner panel in accordance with the present invention.

The general configuration of the panels are shown in FIG. 2, which is an end view of end panel 11. As can be seen, end panel 11 includes a main body panel 11*a* having a first flat 18 and a second flat 17 provided on opposed edges thereof. Panel 11 is manufactured from double faced corrugated paperboard. In particular, a large sheet of double faced corrugated paperboard is cut to the required dimensions and flaps 18 and 17 are formed therein by forming fold lines 25, 26 on the large sheet of corrugated paperboard. It is preferred that the longitudinal axis of the corrugations in the corrugated paperboard extend in a generally vertical direction in panel 11 in order to provide increased strength to the panel and to minimise sagging of the panel when the panel is positioned inside the container.

Figure 3:
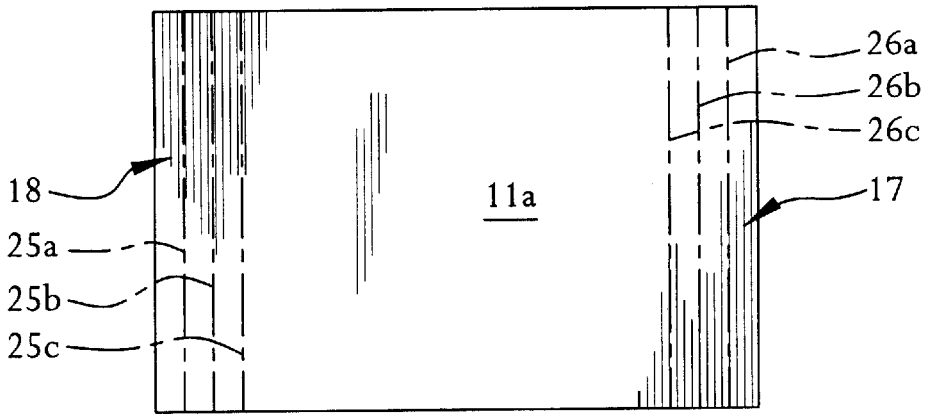
FIG. 3 shows an end view of a liner panel in accordance with another embodiment of the present invention.

An alternative embodiment of the panels is shown in FIG. 3. Again, the panel shown in FIG. 3 comprises an end panel 11 having a main body portion 11*a*. However, as compared with FIG. 2, end panel 11 in FIG. 3 includes fold lines 25*a*, 25*b* and 25*c* formed near one edge thereof Similarly, a plurality of fold lines 26*a*, 26*b*, 26*c* are formed on or near the opposed edge. The size and extent of flaps 18 and 17 shown in FIG. 3 depends upon which fold line the flap is folded out from.

The embodiment shown in FIG. 3 provides a liner panel that has greater flexibility in use. For example, the liner panel shown in FIG. 3 may be fitted to a wider variety of containers because the width of the main body panel 11*a* of panel 11 shown in FIG. 3 may be varied by simply folding flaps 18 and/or 17 around different of the fold lines 25*a*, 25*b*, 25*c* or 26*a*, 26*b*, 26*c*. Similar fold lines can be provided on the other panels 12 to 16 to achieve a similar effect.

Figure 4:
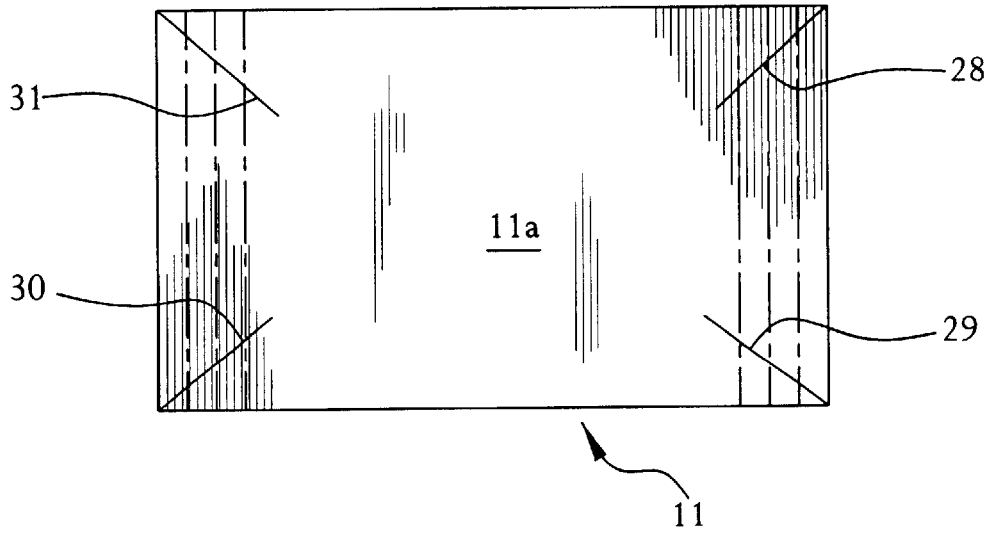
FIG. 4 shows an end view of a liner panel in accordance with a further embodiment of the present invention.

Turning now to FIG. 4, in a further preferred embodiment, the end panel 11 is provided with diagonal cut lines 27, 28, 29, 30. The diagonal cut lines generally extend from each comer of the panel 11 in towards the middle part of the panel. Although called "diagonal" cut lines, it is not strictly necessary that these cut lines exactly follow the diagonal of the panel.

The diagonal cut lines allow the panel 11 to be more easily fitted into containers that have protuberances in the corners thereof. In such cases, the diagonal cut lines simply allow the corner portions of the panel to be folded around the protuberances. Similar cut lines can be provided in the other panels 12 to 16.

Referring back to FIG. 1, it can be seen that a plurality of side wall panels may be provided for each side. Similarly, a plurality of floor panels and a plurality of roof panels may also be provided. This allows the liner to be progressively built up from the rear of the container towards the front of the container. Suitably, the liner may be progressively built up as the container is stacked with cargo.

In order to fit the liner shown in FIG. 1 to a container, end wall panel 11 is positioned next to the end of the container and flaps 17, 18 are folded outwardly such that they lie against a part of the side walls. The rearmost side wall panels 12, 13 are then positioned such that the side wall panels 12, 13 overlie the flaps 18, 17, respectively. The folded panels 17, 18 ensure that a close surface is presented to the rear wall edges of the container.

When rearmost side wall panels 12, 13 are fitted, the opposed flaps on the side wall panels are folded such that the upper flaps lie adjacent to the roof and the lower flaps lie adjacent to the floor. The rearmost floor panel 14 is then positioned over the lower most flaps of side walls 12, 13. Flaps 20, 21 of floor panel 14 are folded upwardly and this assists in ensuring that a closed face is presented to the edges of the container that extend between the side walls and the floors.

The cargo is then stacked in the container substantially to roof level until the cargo essentially covers the rearmost of the floor panels 14. Further side wall panels and floor panels may then be fixed in position. Alternatively, the entire internal space of the container may be lined with the side wall panels and floor panels prior to stacking with cargo.

Once the cargo has been stacked to substantially roof level, the roofing panels 15 are positioned in place by sliding the roof panels over between the roof and the uppermost flaps of the side wall panels 12, 13 or by simply sliding the roof panels over the top of the cargo. The flaps of the roof panels 15 are preferably folded downwardly, although it will also be appreciated that the roof panel may be provided without flaps.

Once the container has been fully lined with the first end panel 11, the side wall panels, the roof panels and the floor panels, and the container fully stacked with cargo, the second end panel 16 is positioned in place and the door of the container closed such that the inside of the door of the container is positioned close to the second end panel 16.

The present invention provides a very simple method for lining a container. The liner is very quick to fit and can greatly reduce the cost of cleaning and turning around a food quality container. Moreover, the liner is preferably made from paperboard and accordingly the liner may be recycled. The liner in accordance with the present invention greatly increases the number of containers that may be suitable candidates as food quality containers and this may save considerable capital outlay in that expenditure on new containers to meet food quality requirements may be reduced or not be required.

What is claimed is:

1. A liner for a container, the container including side walls, at least one end wall, a roof and a floor, the liner including:

at least one first side panel for positioning adjacent a first side wall;

at least one second side panel for positioning adjacent a second side wall;

at least one end panel for positioning adjacent the at least one end wall;

wherein each of said at least one first side panel, at least one second side panel and at least one end panel include a main body panel and further include at least one foldable or hingeable flap provided on at least one edge of said main body panel, each of said panels being made from a self-supporting paperboard material, such as corrugated paperboard whereby the liner does not require separate elements to hold it in place, wherein at least selected ones of each panel has a diagonal cut or slit line extending from each comer to enable portions of the panel to be folded to accommodate corner protuberances in the container.

2. The liner of claim 1, further including one or more of at least one roof panel for positioning above a load of cargo in said container, at least one floor panel for positioning on the floor of the container, and at least one second end panel for positioning adjacent a second end of the container.

3. The liner of claim 2, the second end of the container has one or more doors and the at least one second end panel is located adjacent said one or more doors when said one or more doors is closed.

4. The liner of claim 2, wherein the at least one roof panel includes a main body portion and at least one foldable or hingeable flap provided on at least one edge of the main body panel, the at least one second end panel includes a main body panel, at least one foldable or hingeable flap provided on at least one edge of the main body panel, and/or the at least one floor panel includes a main body panel and at least one foldable or hingeable flap provided on at least one edge of the main body panel.

5. The liner of claim 1, wherein one, some or each of the at least one first side panel, at least one second side panel, at least one said panel, at least one second end panel, at least one roof panel and at least one floor panel include foldable or hingeable flaps provided on two opposed edges of the main body panel.

6. The liner of claim 4 or 5, wherein the flap or flaps provided on an edge or on two opposed edges of the main body panel are formed by forming one or more fold lines to delineate the edge or the two opposed edges of main body panel, each flap being defined by the material between a respective fold line and the edge of the panel.

7. The liner of claim 1, wherein the main body panel of the side panels and end panels have a height that is substantially the same as the internal height of the container, the at least one end panel includes one end panel and this panel has a width that is substantially the same as the internal width of the container, the one end panel has foldable or hingeable flaps provided on two opposed edges of the main body panel, the end panel being fitted into the container by placing the main body portion of the end panel against the end of the container and folding the flaps substantially perpendicularly to the main body panel such that the flaps are adjacent to either side walls of the container or the roof and floor of the container, the end panel being oriented such that flaps lie adjacent the side walls of the container.

8. The liner of claim 1 or 7, wherein the side wall panels include flaps on two opposed edges and are positioned inside the container such that the main body panel lies against the side wall and the flaps are folded substantially perpendicularly to the main body panel with the flaps lying adjacent to the roof and the floor of the container.

* * * * *

UNITED STATES PATENT AND TRADEMARK OFFICE

CERTIFICATE OF CORRECTION

PATENT NO. : 6,308,850 B1
DATED : October 30, 2001
INVENTOR(S) : Coom et al.

It is certified that error appears in the above-identified patent and that said Letters Patent is hereby corrected as shown below:

Column 2,
Line 68, please delete "," and replace with -- . --

Column 3,
Line 29, please delete "Or" and replace with -- or --.
Line 30, please insert -- in -- after the word "assists".

Signed and Sealed this

Ninth Day of April, 2002

*Attest:*

*Attesting Officer*

JAMES E. ROGAN
*Director of the United States Patent and Trademark Office*